United States Patent [19]

Elms et al.

[11] 4,057,750

[45] Nov. 8, 1977

[54] APPARATUS AND METHOD FOR SUSTAINING THE OPERATION OF HID LAMPS

[75] Inventors: Robert T. Elms; Joseph C. Engel, Monroeville; Gary F. Saletta, Irwin, all of Pa.

[73] Assignee: Westinghouse Electric Corporation, Pittsburgh, Pa.

[21] Appl. No.: 684,513

[22] Filed: May 10, 1976

[51] Int. Cl.[2] ..... H05B 41/14; H05B 41/26

[52] U.S. Cl. ..... 315/86; 307/23; 307/27; 307/73; 315/174

[58] Field of Search ..... 315/86, 160, 171, 174–176; 307/46, 48, 66, 73, 75, 86, 23, 27

[56] References Cited

U.S. PATENT DOCUMENTS 3,657,597 4/1972 Moerkens et al. ..... 315/86

FOREIGN PATENT DOCUMENTS 848,007 7/1970 Canada ..... 315/86

*Primary Examiner*—Eugene R. La Roche
*Attorney, Agent, or Firm*—W. D. Palmer

[57] ABSTRACT

To prevent high-intensity-discharge (HID) lamps from extinguishing for prolonged periods due to a power interruption or an appreciable drop in line voltage, a rectifier-battery combination provides standby power for operating a high-frequency inverter. The output of the inverter connects to the HID lamps through impedance means which passes a greatly reduced high-frequency current as compared to the normal lamp operating current, in order to sustain the operation of the lamps at a very reduced power level. Upon restoration of the normal line voltage, the lamps again operate with normal power consumption. The same wiring can be used for both the normal lamp operating current and the high-frequency sustaining current or separate wiring systems can be used if desired. The high-frequency current can be supplied simultaneously with the normal operating current or the high-frequency current can be supplied only during periods of power interruption. In the latter case, the high-frequency sustaining current is continued for a period of at least 0.1 second after restoration of the normal line voltage to prevent the HID lamps from extinguishing.

9 Claims, 9 Drawing Figures

APPARATUS AND METHOD FOR SUSTAINING THE OPERATION OF HID LAMPS

BACKGROUND OF THE INVENTION

This invention relates to apparatus and method for sustaining the operation of HID lamps and, more particularly, to apparatus and method for preventing HID lamps from extinguishing during relatively short periods of power interruption or drop in voltage so that the lamps immediately operate with full power as soon as the normal line voltage is restored.

High-intensity-discharge lamps are widely used for lighting streets, highways, parking lots, stadiums, high-bay factories and more recently have come into use for department store and office lighting. The term HID lamps includes within its scope high-pressure mercury-vapor lamps, mercury-metal halide lamps and high-pressure sodium lamps which incorporate a filling of mercury and sodium. Upon being turned on, all of these lamps require several minutes to achieve their normal operating brightness, during which period of time the discharge-sustaining constituents are building up in pressure. Upon momentary power interruptions or an appreciable drop in line voltage, the lamps will extinguish. Once extinguished, the lamps cannot again be started with the normal starting and ballasting apparatus until the pressure of the discharge-sustaining constituents has dropped and the lamp can be reignited. For most types of HID lamps, this will take several minutes and it frequently can be as much as 10 to 15 minutes before the lamps are operating normally. The effect of a momentary power interruption is most noticeable in a sports arena or stadium since a nationally televised sports program can be interrupted for perhaps 10 to 15 minutes, but the effect is equally bothersome for persons in a supermarket, office, high-bay factory or even a mine which is lighted with HID lamps.

It is possible to restrike HID lamps immediately after they have been extinguished by the application of an extremely high voltage, such as 10 to 20 KV pulses, across the lamp electrodes, but this is not commercially practical for most types of such lamps since a double-ended construction is required to prevent the applied high voltage pulses from short circuiting across the lead-in conductors. In addition, apparatus for generating such extremely high voltage pulses is quite expensive. For this reason, where standby lighting is required, it normally has been customary to provide some sort of standby incandescent lamp which provides a very reduced level of illumination until the HID lamps can be reignited and are again operating with normal power input.

Standby lighting systems have been provided for fluorescent lamps which can be restruck immediately after they are extinguished since these are a low-pressure discharge device and are not required to cool down before being reignited. For fluorescent fixtures, there are presently commercially available standby battery and inverter packs which can provide standby lighting for an individual fixture during periods of power interruption and these battery and inverter packs are designed to fit into or onto an individual fixture. As noted hereinbefore, however, the problems associated with providing standby lighting power for fluorescent lamps are completely different from those encountered with high-intensity-discharge lamps because of the very difficult reignition problems associated with HID lamps.

SUMMARY OF THE INVENTION

The present apparatus and method comprises an improvement for standard HID lighting installations which comprise multiple high-pressure discharge lamps, each having a separate ballast means associated therewith and proximate thereto, together with the customary wiring for connecting the lamps and ballast to the 60 Hz AC source (50 Hz in many foreign countries). The improvement comprises the apparatus and method for preventing these lamps from extinguishing during periods of power interruption of the AC energizing source or during periods of appreciably reduced AC source line voltage, either of which would normally cause the lamps to extinguish for a prolonged period. The improved apparatus comprises a combined rectifier and battery having input terminals adapted to be connected across the AC source in order to provide standby power and a high-frequency inverter means has its input connected across the terminals of the battery, with the inverter when operating functioning to provide a high-frequency AC output voltage sufficient to operate the lamps. The inverter is connected to each of the lamps through impedance means which pass a very reduced high frequency current as compared to the normal lamp operating current so that upon power interruption of appreciable drop in line voltage sufficient to cause the lamps to extinguish, the lamps will continue to be operated from the output of the inverter, but at a very reduced power level. The operation of the lamps is sustained at such reduced power level from available battery power until full line voltage is restored and the lamps are operating with normal power consumption. The inverter may be connected to the lamps through the same wiring as is used to supply the normal 60 Hz current or separate wiring may be utilized. In either case, it is necessary to provide blocking means such as a low-pass filter to block the output of the inverter from the AC source and additional blocking means, such as a capacitor, is provided to block the 60 Hz current from the output of the inverter. The inverter can operate continuously or it can be actuated by a relay so that it operates only when the 60 Hz power is interrupted or the line voltage is appreciably reduced. When the 60 Hz power is restored, it is necessary to operate the inverter for at least about 0.1 second thereafter in order to prevent the lamps from extinguishing.

BRIEF DESCRIPTION OF THE DRAWINGS

For a better understanding of the invention, reference may be had to the preferred embodiments, exemplary of the invention, shown in the accompanying drawings, in which.

DESCRIPTION OF THE PREFERRED EMBODIMENTS

Figure 1:
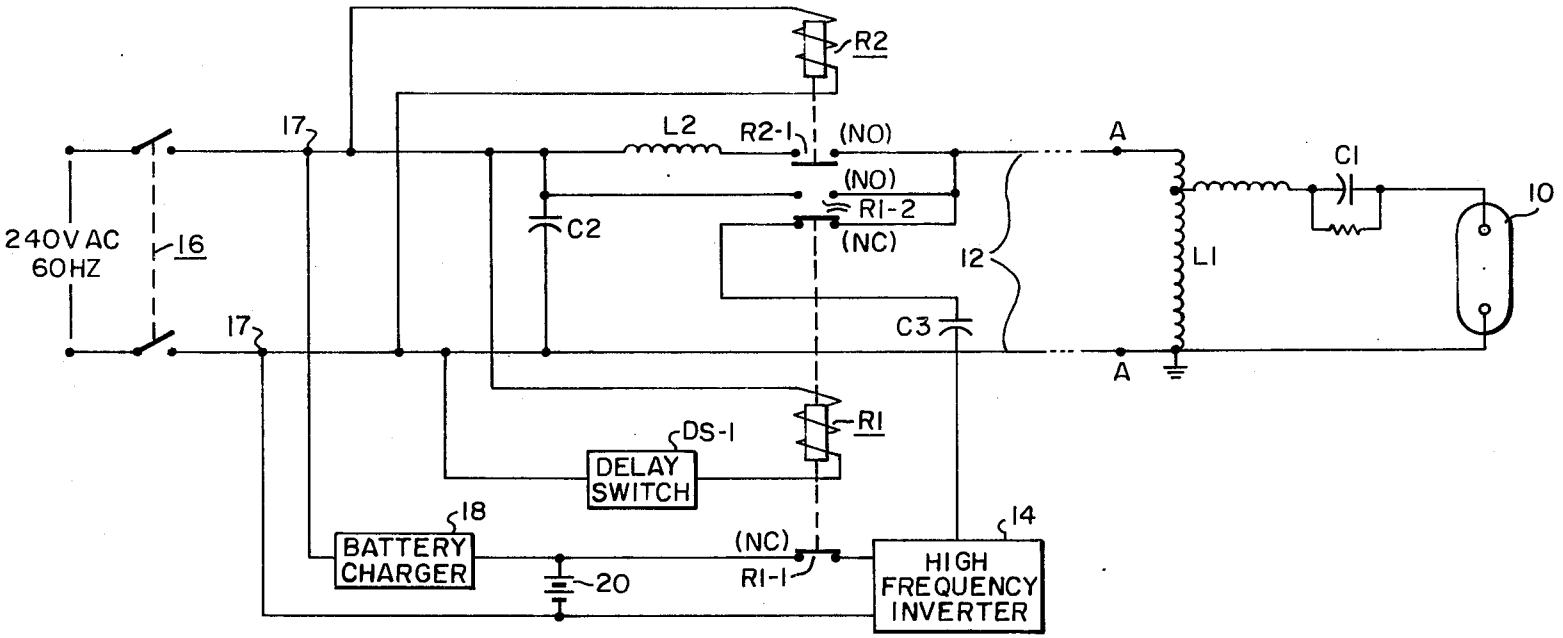
FIG. 1 is a schematic diagram of an HID lamp lighting installation which is modified to incorporate a high-frequency lamp discharge sustaining system particularly adapted for mercury lamps.

The present apparatus operates in combination with a lighting installation which is normally operable from a 60 Hz AC source and comprises multiple high-pressure discharge lamps each having separate ballast means associated therewith and proximate thereto, together with the customary wiring for connecting the lamps and ballast to the 60 Hz AC source for delivering the normal operating 60 Hz current to such lamps. The present improvement comprises apparatus for preventing such HID lamps from extinguishing during periods of power interruption of the AC energizing source or during periods of appreciably reduced AC source line voltage, either of which would normally cause the lamps to extinguish for a prolonged period of time, for reasons as previously explained. A schematic of one of the embodiments of the present apparatus is shown in FIG. 1. Components L1 and C1 comprise a standard 400 watt regulated output ballast which is designed to operate a 400 watt high-pressure mercury-vapor lamp 10. In this embodiment, all of the lamps which are to be operated in one bank, for example, are separately connected to the supply wiring 12 at the points A—A and the high-frequency sustaining current supplied by the single inverter 14 to the lamps is connected through a substantial portion of the same wiring 12.

For normal 60 Hz operation, the main switch means 16 is closed and the 240 volt AC 60 Hz power energizes the lamps and is also available at the input terminals 17 for the standard battery charger 18 which operates from the 240 volt AC supply and trickle charges a conventional battery 20 to 170 volts DC. The battery 20 is thus floated across the line to provide standby power. The battery 20 is isolated from the oscillator-inverter 14 by the contacts R1-1 of relay R1, whose 240 volt AC coil is normally energized during the 60 Hz operation, which deenergizes the inverter 14.

A second set of contacts R1-2 on relay R1 bypasses inductor L2 during 60 Hz operation in order to provide a direct connection between the 60 Hz supply and the regulated output ballast in order to eliminate any voltage drop that may occur in the inductor L2. The inductor L2 and C2 of course functions as a low-pass filter means connected in the wiring 12 intermediate the lamps 10 and the AC source in order to block the output of the inverter 14 from the AC source.

When the 240 volt AC 60 Hz supply is interrupterd or the voltage drops sufficiently as could cause the lamps 10 to extinguish, such as to 100 volts, relay coil R1 is deenergized and contacts R1-1 close, energizing the inverter 14 from the battery 20, and contacts R1-2 switch from the normally open (NO) position to the normally closed (NC) position, thereby connecting the output of the HF oscillator 14 to the regulated output ballast inputs, with the short across the inductor L2 also being opened. As a specific example, the inductor L2 has a value of 40 mh and C2 is 10μf.

Because of the energy stored in the ballast, up to about 25 milliseconds delay can be tolerated in turning on the inverter 14 and regardless of the timing required to turn on the inverter 14, the 60 Hz current in the regulated output ballast will require about 25 milliseconds to decay. For this reason, the relay R1 need not be of an elaborate construction.

It has been found that after the 240 volt AC 60 Hz power is reapplied, it is necessary to continue to supply high-frequency inverter power to the lamp ballast for a period of at least about 0.1 second, and during this period, both the 60 Hz supply and the HF oscillator power will be supplied to the ballast. For such operation, capacitor C3, which has a value of 0.1 microfarad, is included in the line between the lamps and the inverter in order to block any 60 Hz power from the output of the inverter. The low pass filter comprising L2 and C2 prevents any HF power from appearing on the 60 Hz lines. Also included is a delay switch DS-1 which closes about 0.1 second after the 240 VAC power is applied, thus terminating the period of simultaneous application of both 60 Hz and high-frequency power.

Relay R2 is optional. Whenever the 240 VAC is present, the coil of relay R2 is energized and the contacts of R2, in series with the inductor L2, are closed. When the 60 Hz power is interrupted, these contacts open, and it is not necessary to supply the HF reactive power to the filter comprising L2 and C2. This in turn considerably reduces the current and the power losses in the HF inverter transistors and extends the time for which power can be provided for standby lamp excitation from any given capacity battery.

The inverter 14 can be any conventional inverter design and a typical suitable inverter is described in Motorola Semiconductor Products, Inc. booklet designated NA-588. As a specific example, the inverter can be designed to operate at 7 KHz.

Figure 3:
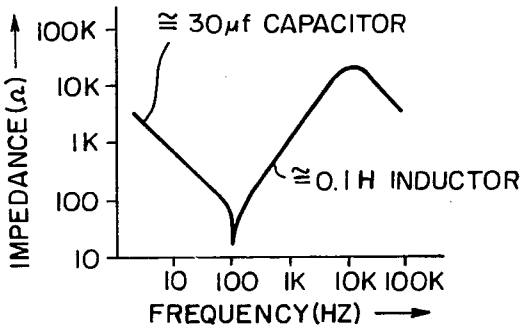
FIG. 3 is a graph of impedance versus frequency showing how the output impedance of a 400 watt regulated output ballast varies with frequency.
Figure 2B:
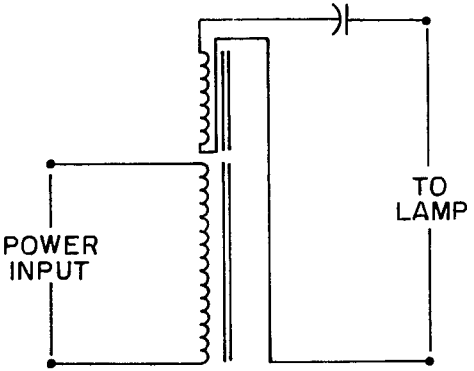
FIGS. 2A and 2B are schematic diagrams of typical regulated output lamp ballasts one of which is normally positioned proximate each lamp.
Figure 2A:
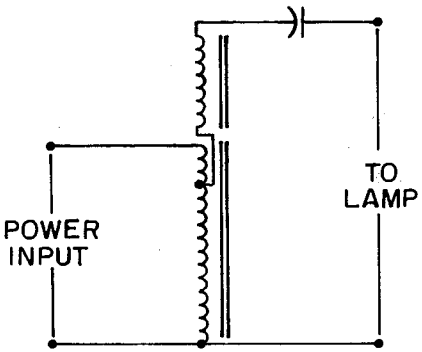

In the embodiment as shown in FIG. 1, the output of the inverter 14 is applied to the lamps 10 through the ballast comprising L1 and C1 and typical regulated output ballasts are shown schematically in FIGS. 2A and 2B wherein the embodiment shown in FIG. 2A has a grounded output and the embodiment shown in FIG. 2B has an isolated output. There is shown in FIG. 3 a typical output impedance for a 400 watt regulated output mercury ballast wherein at an energizing frequency of 60 Hz, the output impedance is approximately 100 ohms and is equivalent to the impedance of a 30 microfarad capacitor. At a frequency of 7 KHz, the output impedance is 5,000 ohms and is equivalent to that obtained with a 0.1 Henry inductor. Thus, for a typical regulated output 400 watt mercury ballast, the same ballast can be used both for the 60 Hz power and the 7 KHz power.

Figure 4:
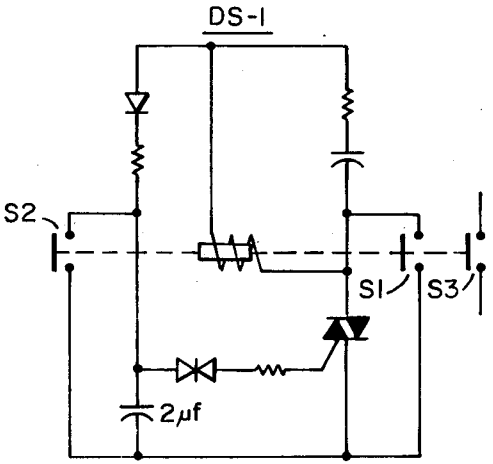
FIG. 4 is a schematic diagram of a 240 volt delay circuit which is shown in block form in the diagram shown in FIG. 1.

The 240 VAC delay switch (DS-1) is shown in FIG. 4 and is of conventional design. When the 240 VAC is applied thereacross, the 2 microfarad capacitor charges toward 240 volts over many cycles. Above 40 volts, the trigger diode fires turning on the triac, which in turn closes the normally open contacts S1 and S2. These remain closed until the 240 VAC is again interrupted, at which time the contacts (NO) will open. Upon closing, contacts S1 provide an alternate path for the relay coil power and simultaneously turn OFF the triac. Contacts S2 discharge the 2 microfarad capacitor to prepare it for the next delayed TURN ON sequence. Contacts S3 are the delayed relay contacts for the external circuitry.

Summarizing the apparatus described hereinbefore, the combined rectifier means 18 and battery means 20 has its input adapted to be connected across the AC source to provide standby power and the high-frequency inverter means 14 has its input connected across the terminals of the battery means 20, with the inverter when functioning providing a high-frequency output voltage, such as 700 volts peak to neutral, sufficient to operate the lamps 10. The output of the high-frequency inverter is connected to each of the lamps through the same impedance or ballast as used with the 60 Hz current, except that at a frequency of 7 KHz, the current through the ballast is considerably reduced with a representative high frequency power input being 40 watts to each 400 watt lamp. Upon power interruption or an appreciable drop in line voltage of the AC source, the lamps are thus operated from the output of the battery means-powered inverter means at a reduced power level, and the operation of the lamps 10 is sustained at such reduced power level from available battery power until the full line voltage is restored and the lamps are operating with normal power consumption. In the embodiment as shown in FIG. 1, the output of the high-frequency inverter 14 connects to the lamps 10 through a substantial portion of the same wiring as used to connect the lamps to the 60 Hz AC source and means connected in the wiring, such as the low pass filter L2-C2, intermediate the lamps 10 and the AC source, blocks the output of the inverter means 14 from the AC source. Also, means, such as the capacitor C3, connected in the wiring intermediate the inverter 14 and the lamps 10, blocks the 60 Hz current from the output of the inverter 14. In the embodiment as shown in FIG. 1, when the power switch 16 is closed, the lamps are connected to the 60 Hz source normally to cause the lamps 10 to operate from the source, and the switch 16 upon closing also connects the combined rectifier 18 and the battery 20 across the 60 Hz AC source to maintain the battery in a charged condition. The relay R1, which is responsive to an interruption or decrease in voltage of the AC source sufficient to extinguish the lamps 10, thus actuates the inverter 14 to an operating condition to sustain the operation of the lamps from available battery power. In this mode of operation, a delay switch or relay DS-1 causes the inverter 14 to operate for an additional period of at least about 0.1 second after normal 60 Hz AC voltage is restored in order to prevent the lamps from extinguishing during the period required to establish full operating power thereto.

Figure 5:
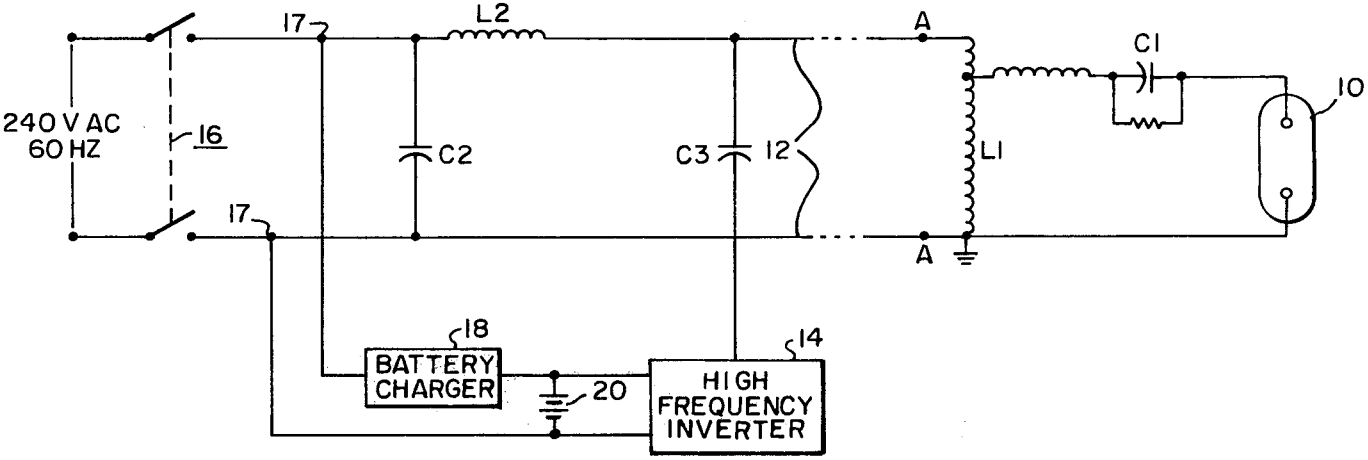
FIG. 5 is a schematic diagram generally corresponding to that shown in FIG. 1 but wherein the high-frequency oscillator continuously operates whenever the lamps are energized and the primary 60 Hz current and the high-frequency sustaining current are supplied to the lamps over the same wiring.

The embodiment as shown in FIG. 5 is similar to the embodiment as shown in FIG. 1, except that the high-frequency inverter 14 operates continuously. The low-pass filter L2-C2 blocks the high-frequency output from the 60 Hz source, and the capacitor C3 blocks the 60 Hz power from the output of the inverter.

Figure 6:
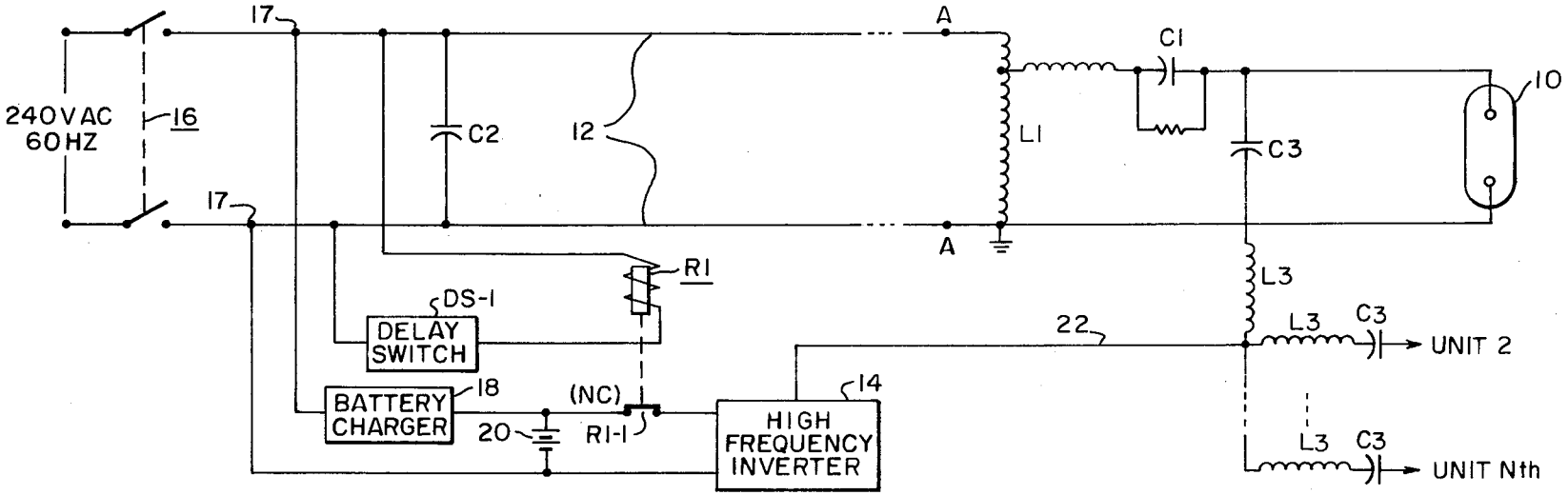
FIG. 6 is a schematic diagram of a modified circuit generally corresponding to FIG. 1 but wherein the high-frequency sustaining current is supplied to the lamps through separate wiring.
Figure 7:
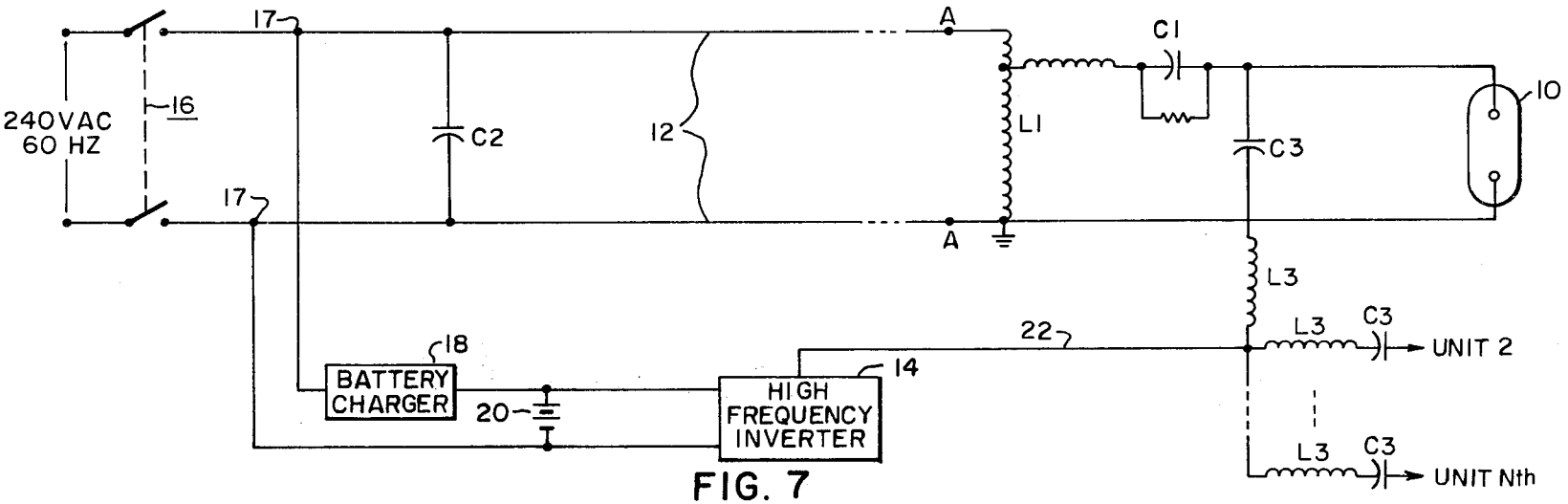
FIG. 7 is a schematic diagram of a circuit generally corresponding to that shown in FIG. 6 but wherein the sustaining high-frequency inverter operates continuously whenever the lamps are energized.

In the embodiment shown in FIG. 6, separate wiring 22 is used to connect the high frequency inverter output to the lamp units and separate ballasts are provided for the high-frequency inverter in the form of the 0.03 Henry inductors L3. In this embodiment, the ballast L1 and capacitor C2 comprise a low pass filter means which blocks the output of the inverter 14 from the 60 Hz source and the capacitor C3 blocks the 60 Hz power from the inverter 14. The relay R1 and associated delay switch or relay DS-1 functions as in the embodiment shown in FIG. 1. The circuit as shown in FIG. 7 is similar to that as shown in FIG. 6, except that the inverter operates continuously so that the lamps are simultaneously energized by the 60 Hz power and the 7 KHz power until such time that the 60 Hz power is interrupted, resulting in the operation of the lamps 10 being sustained by the 7 KHz power alone.

While the foregoing description has considered in detail high-pressure mercury-vapor (HID) lamps, and the regulated output ballasts as are normally used therewith, the present apparatus and method are equally applicable to other types of HID lamps and the customary ballasts as used therewith, examples being mercury-metal halide (HID) lamps and sodium-mercury (HID) lamps.

Figure 8:
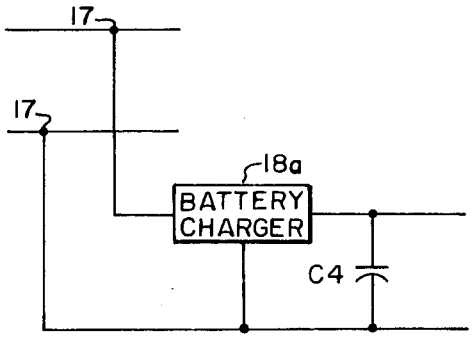
FIG. 8 is a schematic diagram of a modified standby power source which eliminates the battery.

In some cases it may be desirable to provide for standby operation of the lamps 10 only during periods of reduced line voltage which normally would be sufficient to cause the lamps 10 to extinguish. Such an embodiment is readily provided by using a full-wave rectifier **18*a* and replacing the battery 20 with a 600 $\mu$f capacitor C4, as shown in the modified rectifier arrangement of FIG. 8. This modified rectifier arrangement may be incorporated into any of the embodiments as previously shown and described. In the operation of such a system, the high-frequency inverter 14 will operate from a wide range of input DC voltages, such as from 350 to 100, to provide sufficient voltage to operate the lamps 10 during periods of reduced line voltage which would normally be sufficient to cause the lamps 10 to extinguish. Such a system will not provide for standby operation of the lamps 10** during periods of complete power interruption, but for some installations this may not be necessary.

The present system may also be used in conjunction with lamps 10 which normally operate from DC power, such as 300 volts. In such an embodiment, the battery rectifier 18 is merely eliminated from any of the system embodiments as previously shown and described. In the operation of such a modified system, during periods of power interruption or reduced voltage, the high-frequency inverter 14 is operated from available DC energy, provided either from the battery 20 or from the available DC energy of reduced voltage, to provide for standby operation of the lamps 10.

The power input to the lamps during standby operation is conveniently established at about 10 percent of the rated lamp power input. With standby power inputs greater than this value, battery reserves will be depleted more rapidly. With standby power inputs appreciably less than this value, some problems with the lamps extinguishing can be encountered. In the case of lengthy electrical lines from the inverter to the lamps and ballasts, additional power input is needed to offset the loss in the lines.

We claim:

1. In combination with a lighting installation which is normally operable from a 60 Hz AC source and comprises multiple high-pressure discharge lamps each having separate ballast means associated there-with and proximate thereto together with the customary wiring for connecting the lamps and ballasts to the 60 Hz AC source for delivering the normal operating 60 Hz current to such lamps, the improvement which comprises apparatus for preventing such multiple lamps from extinguishing during periods of power interruption of the AC energizing source or during periods of appreciably reduced AC source line voltage, either of which would normally cause the lamps to extinguish for a prolonged period, said apparatus comprising:

a. combined rectifier means and battery means having input terminals adapted to be connected across said AC source to provide standby power;

b. a single high-frequency inverter means having an input and an output, means for connecting the input of said inverter means across the terminals of said battery means, said inverter means when functioning providing a high-frequency AC output voltage sufficient to operate said lamps;

c. means for connecting the output of said high-frequency inverter means to each of said lamps through impedance means which pass a very reduced high-frequency current as compared to normal lamp operating current so that upon power interruption or appreciable drop in line voltage of said AC source, said lamps are operated from the output of said battery means-powered inverter means at a reduced power level and operation of said lamps is sustained at such reduced power level from available battery means power until full line voltage is restored and said lamps are operating with normal power consumption, and means connected in the wiring intermediate said lamps and said AC source blocks the output of said inverter means from said AC source, and means connected in the wiring intermediate said inverter means and said lamps blocks 60 Hz current from the output of said inverter means.

2. The combination as specified in claim 1, wherein said high-frequency inverter means connects to said lamps through a substantial portion of the same wiring as used to connect said lamps to said 60 Hz AC source.

3. The combination as specified in claim 2, wherein said means connected in the wiring intermediate said lamps and said AC source to block the output of said inverter means from said AC source is low-pass filter means, and said means connected in the wiring intermediate said inverter means and said lamps to block 60 Hz current from the output of said inverter means is capacitor means.

4. The combination as specified in claim 2, wherein switch means when closed connects said lamps to said 60 Hz AC source to cause said lamps to operate, and said switch means when closed also causes said inverter means to operate in a continuous fashion.

5. The combination as specified in claim 2, wherein switch means when closed connects said lamps to said 60 Hz AC source normally to cause said lamps to operate from said source, and said switch means when closed also connects said combined rectifier means and battery means across said 60 Hz AC source to maintain said battery means in a charged condition, relay means responsive to an interruption or decrease in voltage of said AC source sufficient to extinguish said lamps actuates said inverter means to an operating condition to sustain the operation of said lamps from available battery power, and delay relay means causes said inverter means to operate for an additional period of at least about 0.1 second after normal 60 Hz AC voltage is restored to prevent said lamps from extinguishing during the period required to establish full operating power thereto.

6. The combination as specified in claim 1, wherein said high-frequency inverter means connects to said lamps substantially through different wiring than is used to connect said lamps to said 60 Hz AC source.

7. The combination as specified in claim 6, wherein said means connected in said wiring intermediate said lamps and said AC source to block the output of said inverter means from said AC source is low-pass filter means, and said means connected in said wiring intermediate said lamps and said inverter means to block 60 Hz current from the output of said inverter means is capacitor means.

8. The combination as specified in claim 6, wherein switch means when closed connects said lamps to said 60 Hz AC source to cause said lamps to operate, and said switch means when closed also causes said inverter means to operate in a continuous fashion.

9. The combination as specified in claim 6, wherein switch means when closed connects said lamps to said 60 Hz AC source normally to cause said lamps to operate from said source, and said switch means when closed also connects said combined rectifier means and battery means across said 60 Hz AC source to maintain said battery means in a charged condition, relay means responsive to an interruption or decrease in voltage of said AC source sufficient to extinguish said lamps actuates said inverter means to an operating condition to sustain the operation of said lamps from available battery power, and delay relay means caused said inverter means to operate for an additional period of at least about 0.1 second after normal 60 Hz AC voltage is restored to prevent said lamps from extinguishing during the period required to establish full operating power thereto.

* * * * *